US006047991A

United States Patent [19]

Finke et al.

[11] Patent Number: 6,047,991

[45] Date of Patent: Apr. 11, 2000

[54] SECURITY LABEL SYSTEM

[75] Inventors: Evan Finke, Desplaines; Malcolm K. Finke, Chicago; Marshall Weinstein, Riverwoods, all of Ill.

[73] Assignee: Specialty Store Services, Inc., Morton Grove, Ill.

[21] Appl. No.: 08/978,672

[22] Filed: Nov. 26, 1997

Related U.S. Application Data

[63] Continuation of application No. 08/677,473, Jul. 10, 1996, Pat. No. 5,732,979.

[51] Int. Cl.[7] ..... B42D 15/00

[52] U.S. Cl. ..... 283/81; 29/271

[58] Field of Search ..... 283/81, 100, 56, 283/72, 79, 74, 80, 67, 70; 40/340; 29/271, 404; 156/60, DIG. 1, DIG. 2; 261/47

[56] References Cited

U.S. PATENT DOCUMENTS 4,652,473 3/1987 Han ..... 283/100

5,543,001 8/1996 Casillo et al. ..... 283/81 X 5,732,979 3/1998 Finke et al. ..... 283/81

*Primary Examiner*—Willmon Fridie, Jr.

*Attorney, Agent, or Firm*—Roper & Quigg

[57] ABSTRACT

A security label system includes a security label, a protective label, and a means for applying said labels to an item using an applicator workstation. Preferably, said security label system inexpensively and readily identifies and protects compact disc multimedia from theft or damage occurring during sale or rental. Said security label system includes tamper-evident, non-transferable security labels and a reliable means of identification that does not damage or interfere with delicate digital data. In particular, a security label system readily informs merchants if merchandise has been tampered with.

8 Claims, 1 Drawing Sheet

SECURITY LABEL SYSTEM

This application is a continuation of application Ser. No. 08/677,473 filed Jul. 10, 1996 which application is now U.S. Pat. No. 5,732,979.

BACKGROUND OF THE INVENTION

1. Field of the Invention

This invention relates to security label systems, and more particularly to the advantageous use of security labels to indicate when an item has been tampered with.

2. Brief Description of the Prior Art

The merchandising of compact disc (hereinafter "CD") multimedia is a growing industry. CD multimedia are used in audio, video, audio-video, and computer based applications. Since many similar looking duplicate recordings for a particular CD program are often available from many different sources, it is difficult for merchants to track, identify, and distinguish their inventory from the inventory of others.

Security is an important concern associated with the rental, loan, or sale of such merchandise. Items such as commercially prerecorded compact disc programs are available from rental shops, stores, and libraries. It is important for a merchant to have a simple means to secure and identify its merchandise. For example, a merchant needs to determine whether merchandise which was rented from it is the same merchandise that is being returned to it to deter customers from attempting to switch good rented merchandise with bad return merchandise (such as a customer's scratched disc).

The switching of CDs in good condition with defective CDs obtained from other sources is a difficult problem that merchants face. Merchandise switching is a significant problem given the high volume of business involved in the compact disc industry and the difficulty of detecting such illegal switching. An easy and reliable way for a merchant to determine whether the digital data contained on a CD is damaged or defective is required. Although obvious imperfections such as scratches or cracks may be detected by a simple visual inspection, such inspection cannot detect defects in the digital data. Even though defects may be discovered during regular speed playback of an entire CD, such means is commercially impractical since it requires too much time for merchants dealing in high volume to check every CD returned to them. Although high-speed electronic scanning devices for checking digital recordings currently exist, such devices are effectively unavailable to the individual merchant due to cost prohibitions and the limited availability of such technology.

Thus, there is a need for merchants to conveniently and inexpensively maintain the security of their merchandise. In the past, merchants have unsuccessfully employed various methods in an attempt to track and identify their inventory. Engraving, stamping, painting, and marking are several methods that merchants have employed. Due to practical problems, those methods are not effectively applicable to the CD multimedia rental industry.

As is known in the art and industry of compact disc multimedia, graphical information identifying the program title and author of a recording is ordinarily placed on the top surface of a CD. Digital data is stored on or just below that top surface. In particular, digital data is stored immediately below such graphical information between the top surface and the bottom surface of the CD. The bottom surface of the CD is comprised of a section of clear material through which, in accessing the data, a laser beam from a compact disc player radiates upward.

The digital data is delicate and can easily be damaged during processes typically used to identify merchandise which include engraving, stamping, or marking. As stated above, the digital data is closer to the top surface of the CD than it is to the bottom surface. Although the top surface of a CD usually contains graphical information applied by silk screening which partially protects the digital data from damage, the silk screened layer is thinner and more fragile than the bottom surface of a CD which comprises clear material. Thus, there is a greater need to protect the top surface of the CD and the digital data close to it from physical damage such as scratching.

Engraving may be used to identify merchandise. Engraving CDs with identification markings is problematic since engraving is often attempted on the top surface of the CD and such engraving could interfere with the digital data next to it. Moreover, even if engraving is attempted on the bottom surface of a CD where it is less likely that digital data will be damaged, the data may still be damaged during engraving due to the pressure required to be placed on the top of the CD to hold it in place and the heat that may result from such engraving. In addition, engraving may be undesirable since it is a relatively labor intensive and costly process, especially in high volume situations.

Thus, merchants have considered other less invasive methods of identification such as, for example, painting. Painting also fails to provide an effective means of identification or security due to the labor required, the cost required, and the inherent unreliability of the process given the ease with which a person can duplicate such painting. Moreover, painting may pose other problems since harm to the digital data must be avoided.

Still another option of identifying and securing inventory is the use of ordinary adhesive stickers. Such stickers do not provide an effective means of identification due to the ease with which such stickers can be removed and reaffixed to similar looking items without a means of clearly indicating any tampering with the sticker. In addition, such stickers may be difficult to manually apply to CDs (since any sticker should be precisely centered on the CD) in the absence of an applicator workstation such as the one disclosed herein. In addition, such stickers may be easy to duplicate.

As a result, heretofore, there has been no inexpensive and effective system to maintain the security of said items as provided by this invention.

Accordingly, it is an object of this invention to provide a security label system that overcomes the aforementioned problems in the prior art.

It is a specific object of this invention to provide an inexpensive means for a merchant to readily identify and distinguish his merchandise from similar looking merchandise.

It is another object of this invention to provide an inexpensive means for a merchant to protect his merchandise from tampering, theft, and damage.

It is a further object of this invention to provide a means for manually and conveniently applying a specially formulated non-transferable security label or a protective label to merchandise such as compact disc multimedia.

SUMMARY OF THE INVENTION

A security label system is disclosed wherein security labels can be conveniently attached to various items such as rental merchandise consisting of videos, computers, or, more particularly, CD multimedia. The security labels provide a reliable means for identifying said items such that an item can be distinguished from similar looking items. Items such as CD multimedia may be similar in appearance since typically the same graphical information indicating the title and author of a particular program is printed on the top surface of that program by the manufacturer. However, the security label system of the invention may identify merchandise as belonging to a particular merchant, store, library, or person.

The security label may employ an automatic identification technology, such as bar-coding, to rapidly, accurately, and reliably identify merchandise. Such technology has been an effective means of data entry and identification for various items such as supermarket goods, blood collection, video recorder rentals, as well as bibliographic items from libraries, publishers, book sellers and the like. In this invention, an item of merchandise stock information can be coded on a security label which is then affixed to merchandise such that the information can be repeatedly scanned and entered into a computer without the need for manual entry. In that way, merchandise may be efficiently identified and tracked. Customized security labels may be individually printed or coded in a batch process for a particular merchant such that the batch of labels may be used to identify various merchandise with a particular merchant or store name.

Therefore, the invention can be used for the inventory, identification, security, and protection of merchandise. This invention will enable a merchant to detect a scenario where a customer has rented or purchased a CD, removed a security label from the CD, attempted to place the security label on an identically appearing defective copy of the CD, and returned the defective copy with the original security label in attempt to obtain credit for returning the original CD. Switching and similar unlawful acts are common due to the ease and relatively inexpensive practice of producing counterfeit copies of CDs. Counterfeiting of the security label can be minimized by employing a security label having distinctly printed information shaded on hard to reproduce colors and backgrounds and other special features as described herein to enable the merchant to distinguish them from counterfeits. For example, merchants can employ security labels that have their own special bar-coding format or they can use standard coding placed in non-obvious locations as described herein. In addition, for example, the security label can have a special reflective surface such that when highly illuminated, it reflects a color different from its ordinary color. Said security system will help deter customers from attempting switching; if, however, a switch of merchandise is attempted, said security label system will alert a merchant of the attempted switch.

The security label may be thin, annular in shape, and flat on both top and bottom surfaces. It is preferably placed on the top surface of a CD. Printed information may appear on top of the security label to provide a means for identifying the merchandise with a particular merchant and a warning to prevent tampering with the security label. In addition, the security label preferably has a means for detecting and indicating tampering such that, if removal is attempted, a fracturing of a polyester/metal bond will result leaving the word "void".

A second label called a protective label may either be used separately or in conjunction with said security label to provide a means for protecting the top surface of the CD and the fragile digital data contained just below it. As described herein, either the security label or the protective label, or both, can be manually applied to the CD using an applicator workstation which essentially comprises a platform having a cushioned top with a frustoconical insertion cylinder protruding upward from the center of the platform.

BRIEF DESCRIPTION OF THE DRAWINGS

For a more complete understanding of this invention, reference now should be made to the embodiment illustrated in greater detail in the accompanying drawings and described by way of example only. In the drawings.

DETAILED DESCRIPTION

While the particular security label system illustrated in FIGS. 1 through 5 and described above is useful for identifying and protecting compact disc multimedia, it will be recognized by those skilled in the art that by making obvious alterations to the dimensions, shapes and features of aspects of this invention, the security label system disclosed herein is usefull for identifying and protecting other objects as well as compact disc multimedia.

Figure 1:
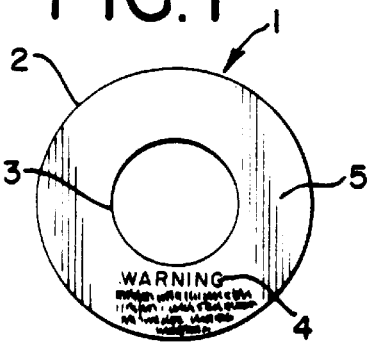
FIG. 1 is a top view of security label 1.

FIG. 1 shows security label 1 according to the present invention. Security label 1 has outer circumference 2 and inner circumference 3. Security label 1 contains printed information 4 on face 5. Security label 1 may be thin relative to the thickness to compact disc multimedia, annular in shape, and flat on both top and bottom surfaces. The bottom surface of security label 1 may have an adhesive material to adhere a removable paper backing to it. Said adhesive backing on security label 1 may be peeled off manually immediately before application of security label 1 to CD 32 illustrated in FIG. 3 using applicator workstation 20 illustrated in FIG. 4 and described below. Manufacturer's information separate from said printed information 4 is often contained on the top surface of CD 32 to identify the program and artist of CD 32.

Security label 1 may be annular in shape similar to the shape of CD 32 wherein an inner diameter along inner circumference 3 is equal to or slightly larger than an inner diameter of CD 32. Security label 1 may have an outer diameter along an outer circumference 2 smaller than an outer diameter of CD 32 so that security label 1 will not hang over CD 32 when security label 1 is concentrically placed on top of CD 32. An annular shape is preferred as indicated in FIG. 1 so that security label 1 does not create rotational imbalances or asymmetries that might result during rotation of CD 32 when data is accessed therefrom if security label 1 were nonconcentrically placed on top of CD 32. Security label 1 may be thin enough such that it may fit on top of CD 32 and properly fit and rotate inside a CD player. Security label 1 is preferably placed on the top surface of CD 32 because, if it were placed on the bottom surface, it could interfere with the access of digital data by impeding the laser light beam from radiating up through the bottom of CD 32 which could adversely affect performance.

Printed information 4 may appear on the top surface of said security label 1. Printed information 1 may provide a means for identifying merchandise and associating it to a particular merchant by including the merchant's store name or code. Security label 1 is typically applied to the top of CD 32 so that it does not interfere with the reading or playback of the digital data when the laser beam radiates upward toward CD 32 spinning above it.

Preferably, security label 1 may employ an automatic identification technology, such as bar-coding, to rapidly, accurately, and reliably identify merchandise. In this invention, merchandise stock information can be coded on security label 1 which is then affixed to merchandise such that the printed information 4 can be repeatedly scanned and entered into a computer without the need for manual entry. In that way, merchandise, such as CD 32 depicted in FIG. 3, may be efficiently identified and tracked. Customized security labels may be individually coded in a batch process for a particular merchant or store name.

In addition, printed information 4 may provide a warning to customers as well as any other user of the multimedia. The warning message, for example, could read as follows: "WARNING: This is a security label. Customer must purchase item if label is altered, removed, or tampered with." Preferably, security label 1will extend radially outward at least as far as is required to provide enough space to fit said printed information 4 such that it is readable to the human eye or to a scanning device. Preferably, printed information 4 should not interfere with the digital data resting near the graphic side nor otherwise affect the view of any graphics printed by the manufacturer on CD 32 which identify CD 32.

As described above, security label 1 may feature a printed "Warning" so that the user of CD 32 cannot persuasively claim that an attempt to remove security label 1 was inadvertent. However, even if the user claims that security label 1 was inadvertently removed and that the item a user is presenting to the merchant is the original item, the security label system alerts the merchant to the possibility of switched merchandise and establishes a need to check the item for proper functioning. Using the invention in this manner will save a merchant resources and time since resources used to check whether merchandise has been tampered with will be better conserved as there is a greater need to check merchandise that indicate a likelihood of having been tampered with.

Such security label 1 may be a computer imprintable matte top-coated metallized polyester film, backed with a semi-bleached kraft release liner which is coated on the backside to prevent removal from an item to which it has been applied. If removal is attempted, a fracturing of a polyester/metal bond will result leaving the word "void", a checkerboard pattern on the item, or some other appropriate indication of tampering 11. Such security label 1 may be purchased, for example, from FLEXcon Graphic Films Inc. located in Spencer, Mass. under the trade name of CONPUcal II TAMPERmark MM-200-S VOID MTC-329 L-156 SPEC 50 K/Q-8.

In particular, if security label 1 is tampered with, a mark, blotch, or clear area may appear on security label 1 and a mark different in color from the surface of the item may remain on the item thereby providing an indication of tampering 11 with respect to the label. More specifically, if removal of security label 1 from an item is attempted, part of the material comprising security label 1 will remain on the original merchandise and only part of security label 1 will remain on the counterfeit item, and thus it will be clear to a merchant that security label 1 has been damaged and tampered with. The damage to security label 1 would preferably be readily apparent to the human eye as security label 1 may appear translucent in some areas and may have its original appearance in other areas. The damaged security label 1 may be translucent in areas where the original label could not be removed from CD 32 thereby leaving a residue on the merchandise and an area of translucence on security label 1 resulting from partial separation of a clear polyester top layer of security label 1 from a colored metal adhesive layer of security label 1 bonded to it. Thus, once security label 1 has been applied to and cured on the item, preferably it cannot be fully transferred from one item to another without destruction.

Figure 2:
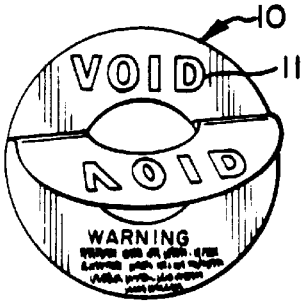
FIG. 2 is a top view of voided security label 10.

Thus, the invention has a means to detect and indicate tampering which is summarized as follows. Security label 1 may be applied to CD 32 using applicator workstation 20 pictured in FIG. 4 and described below. After allowing enough time for security label 1 to "cure," a means of indicating tampering 11 may be activated with respect to CD 32 that is rented or sold by the merchant. As illustrated in FIG. 2, after curing, if security label 1 is attempted to be removed from CD 32, security label 1 will become a voided security label 10. A residue indicating tampering 11 will remain on voided security label 10 which is affixed to CD 32 from which removal of security label 1 was attempted.

Figure 3:
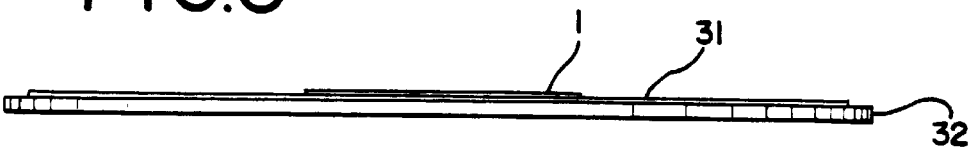
FIG. 3 is a side view of security label 1 attached to protective label 31 which is attached to CD 32.

FIG. 3 is a side view of security label 1 that is attached to protective label 31 that is attached to CD 32. Protective label 31 may either be used separately or in conjunction with security label 1 as part of the security label system of the invention. Protective label 31 may be placed on the top surface of CD 32 using applicator workstation 20. Next, security label 1 having a small outer diameter may be thereafter placed on top of protective label 31 which has a larger diameter sufficient to cover the entire top surface of CD 32. Alternatively, security label 1 may be placed directly on top of CD 32 if using protective label 31 is not preferred. Protective label 31 should preferably be comprised of a clear material so as not to interfere with the view of the manufacturer's printed graphics which identify the program of CD 32. Protective label 31 may provide a means for protecting the top surface of CD 32 and fragile digital data contained just below it. Said protective label 31 may be made of a tough clear material such as Mylar so that CD 32 multimedia information may be protected from scratches and scrapes resulting from ordinary use of CD 32.

Figure 4:
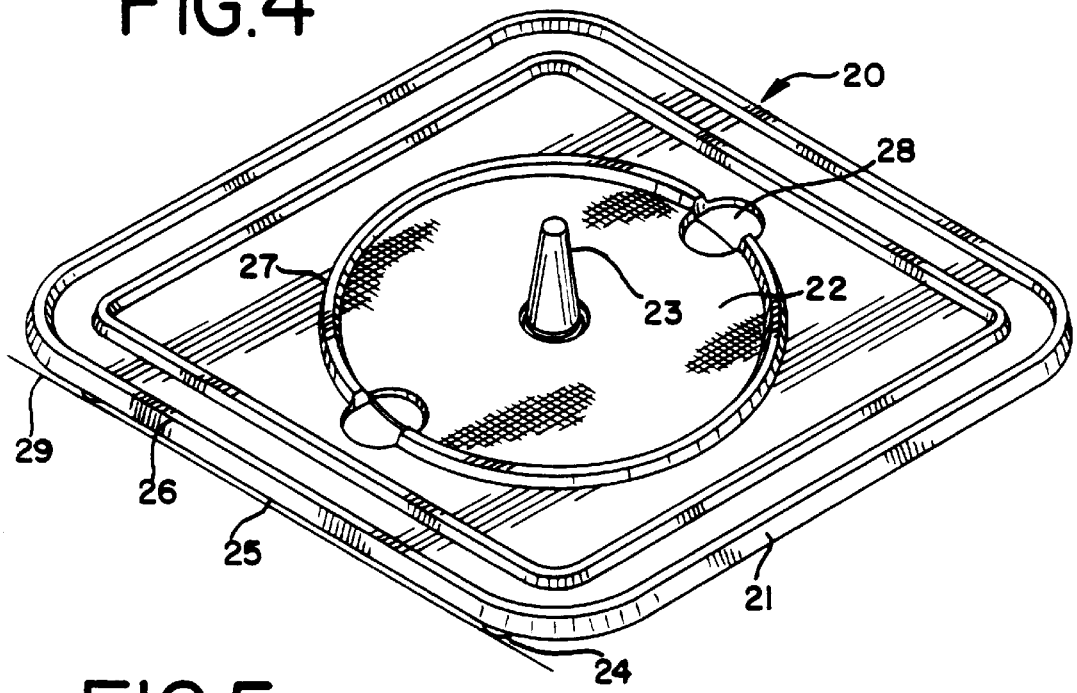
FIG. 4 is a perspective view of applicator workstation 20.
Figure 5:
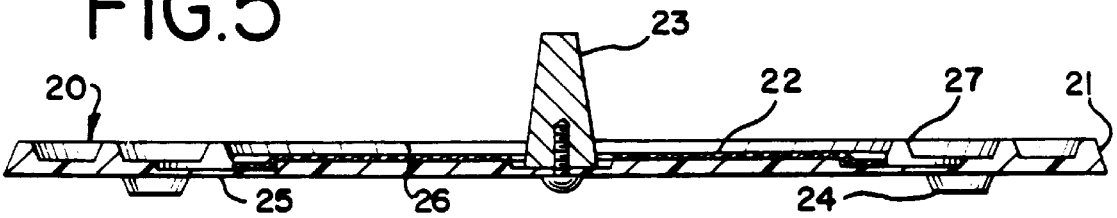
FIG. 5 is a side view of applicator workstation 20.

Security label 1 and protective label 31 are easy and inexpensive to affix CD 32 using applicator workstation 20 which is illustrated in FIG. 4. The application process does not require costly engraving which may damage the item. Security label 1 may be applied manually to CD 32 as follows. First, the merchandise preferably may be placed on applicator workstation 20. If, for instance, the merchandise is compact disc multimedia, said applicator workstation 20 may provide a steady platform 21 to securely hold CD 32 still for quick, accurate positioning so that the security label may be applied. Platform 21 may be a rectangular plastic plate having supports 24 on a bottom surface 25 of platform 21 to allow platform 21 to rest on surface 29. Because CD 32 may easily be damaged, applicator workstation 20 preferably should have a cushioned top 22 such as a felt, foam or cloth pad suitable to prevent scratching of the bottom of CD 32 while security label 1 and/or protective label 31 is applied to CD 32. Top 26 of platform 21 will be molded with circular containment lip 27 to contain CD 32 circumferentially around it as illustrated in FIG. 3.

Platform 21 should be large enough so that CD 32 may be positioned inside it using applicator workstation 20 as described herein. Applicator workstation 20 may have a frusto-conical insertion cylinder 23 which protrudes upward from the center of platform 21. The top of platform 21 is preferably molded with a circular containment lip 27 having a slightly larger diameter than the outer diameter of CD 32 so that CD 32 may rest snugly inside platform 21 during the application of security label 1 or protective label 31. Containment lip 27 contains and supports CD 32 circumferentially so that CD 32 will not move during the application of said labels.

CD 32 may be positioned in applicator workstation as follows. CD 32 may be manually grasped on its outside edges and slowly lowered onto applicator workstation 20 which rests firmly on surface 29 which may be a table top. A hole in the center of CD 32 may be positioned and inserted over insertion cylinder 23 protruding upward from applicator workstation 20. Insertion cylinder 23 is narrow at the top (for ease of insertion of CD 32) and larger in diameter at the bottom so that CD 32 may be properly centered as it is lowered into applicator workstation 20. Once so lowered, CD 32 will thereby be resting on cushioned top 22 of platform 21. To prevent damage to CD 32, cushioned top 22 may be comprised of a soft material such as felt, foam, or cloth.

Once CD 32 is in position in applicator workstation 20, security label 1 and/or protective label 31 may conveniently be concentrically placed on the top of CD 32. Insertion cylinder 23 of applicator workstation 20 facilitates the application of said labels. At the top of insertion cylinder 23, it has a diameter smaller than the inner diameter of security label 1 to facilitate insertion. The positioning of said labels inside applicator workstation 20 is done by a similar process as is the positioning of CD 32. Said labels may be applied as follows. Security label 1 is placed over the top of insertion cylinder 23 of applicator workstation 20. As security label 1 is further lowered toward CD 32, insertion cylinder 23 increases in diameter so that security label 1 may be properly centered and attached to CD 32. A protective backing contained on security label 1 is then manually removed from security label 1 to expose an adhesive surface. Once exposed, security label 1 is ready to be affixed to CD 32 or to protective label 31 which has been affixed to CD 32 as illustrated in FIG. 3.

After security label 1/protective label 31 has been applied to CD 32, CD 32 can be manually removed from applicator workstation 20 using two finger slots 28 which are cavities in both top 26 of platform 21 and in containment lip 27. Finger slots 28 provide a means to enable a person to easily remove CD 32 from applicator workstation 20 after it has been labeled by manually lifting CD 32 therefrom. Once removed, the CD employing the security label system can be rented to a customer.

What is claimed is:

1. A compact disc multimedia holder for facilitating the application of a label to a compact disc multimedia having a central aperture, a bottom surface, and a top surface, comprising:

a platform comprising an upper surface, said upper surface of said platform comprising a cushion for protecting said bottom surface of said compact disc multimedia positioned thereon; said cushion having a surface area at least as large as the surface area of said bottom surface of said compact disc multimedia;

a rigid insertion guide extending transversely from said upper surface of said platform whereby said insertion guide is adapted to fit within said central aperture of said compact disc multimedia permitting said bottom surface of said compact disc multimedia to rest upon said upper surface of said platform, and whereby said insertion guide facilitates the positioning of labels on said top surface of said compact disc multimedia.

2. The compact disc multimedia holder of claim 1 wherein said cushion comprises fabric.

3. The compact disc multimedia holder of claim 2 wherein said fabric comprises felt.

4. The compact disc multimedia holder of claim 1 wherein said cushion comprises an elastomer.

5. The compact disc multimedia holder of claim 4 wherein said elastomer comprises foam rubber.

6. The compact disc multimedia holder of claim 1 wherein said platform further comprises one or more finger tabs that facilitate the removal of said compact disc multimedia from said upper surface of said platform.

7. The compact disc multimedia holder of claim 1 wherein said rigid insertion guide further comprises an outer surface, wherein said outer surface of said rigid insertion guide is a cylinder having an outer diameter approximately equal to the diameter of said central aperture of said compact disc multimedia.

8. The compact disc multimedia holder of claim 1 wherein said outer surface of said rigid insertion guide is frustoconical having a bottom portion proximate to said platform, wherein said bottom portion has a diameter approximately equal to the diameter of said central aperture of said compact disc multimedia.

* * * * *